US006871754B2

(12) United States Patent
Hamida et al.

(10) Patent No.: US 6,871,754 B2
(45) Date of Patent: Mar. 29, 2005

(54) CONTAINER UNDER VARIABLE PRESSURE, IN PARTICULAR HEAT-EXCHANGE CONDENSER

(75) Inventors: Jamil Ben Hamida, Foetz (LU); Herve Charlot, Thionville (FR); Michel Lentgen, Hettange Grande (FR)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/422,617

(22) Filed: Apr. 24, 2003

(65) Prior Publication Data

US 2003/0226850 A1 Dec. 11, 2003

(30) Foreign Application Priority Data

May 16, 2002 (FR) ..... 02 06030

(51) Int. Cl.[7] ..... B65D 45/00

(52) U.S. Cl. ..... 220/315; 220/DIG. 19; 220/DIG. 20

(58) Field of Search ..... 220/315, 314, 220/316, 323, 238, 318, DIG. 19, DIG. 20; F16J 13/02

(56) References Cited

U.S. PATENT DOCUMENTS 4,921,123 A * 5/1990 Mizioch ..... 220/323
5,255,815 A * 10/1993 Renk et al. ..... 220/323
5,405,001 A * 4/1995 Lillard ..... 206/221
5,533,802 A * 7/1996 Garganese ..... 366/256

FOREIGN PATENT DOCUMENTS

| | | | |
|---|---|---|---|
| EP | 1132695 | 9/2001 | |
| FR | 2798456 | 3/2001 | |
| FR | 2822518 | * 9/2002 | ..... 220/315 |

* cited by examiner

*Primary Examiner*—Lien Ngo
(74) *Attorney, Agent, or Firm*—Patrick M. Griffin

(57) ABSTRACT

The container is connected to a tube (1) defining an opening (2) of the container to the outside, the opening being able to be closed by a plug (3) suitable to be introduced by axial sliding into the tube (1). The plug (3) is associated with a plate (7) co-operating with axial locking means (8, 9) provided in the tube (1) and allowing the plate (7) to extend transversally in this in front of the plug (3) to prevent the removal of this when there is an over-pressure in the container. The axial locking means (8, 9) of the plate (7) include a first slot (8) in the wall of the tube (1) and a second slot (9) diametrically opposed to the first slot (8). The plate (7) is suitable to be introduced transversally into the tubular element (1) through the first slot (8) and to project outside the tubular element through the second slot (9).

8 Claims, 2 Drawing Sheets

CONTAINER UNDER VARIABLE PRESSURE, IN PARTICULAR HEAT-EXCHANGE CONDENSER

TECHNICAL FIELD

The present invention relates generally to containers under variable pressure and more particularly to condensers of heat-exchangers in a motor vehicle air-conditioning plant.

BACKGROUND OF THE INVENTION

Containers of this type include, inter alia, a replaceable cartridge filled with desiccating granules. This cartridge is introduced into a tubular element defining an opening of the container to the outside. This opening can be closed by means of a plug provided with O-rings and which can be introduced by sliding into the tubular element. Inward displacement of the plug is limited by a stop means in the form of a circular shoulder on the internal surface of the tubular element.

To prevent the plug from coming out when the pressure in the container increases on operation of the plant, other detachable axial stop means can be located inside the tubular element in order to limit the outward movement of the plug.

For obvious reasons of safety, it is desirable for it to be impossible to remove the detachable axial stop means while an over-pressure exists inside the container. In other words, the operator must wait until the pressure inside the container has fallen practically to atmospheric pressure to be able to remove the plug to then have access to the inside of the tubular element in order, for example, to change the cartridge with desiccating granules.

A container is known from FR-2 798 456 in the form of a collector for a condenser of an air-conditioning plant. This collector includes a tubular element closed by a cylindrical plug, the outward displacement of which is prevented by axial stop means formed of a circlip in the form of a split elastic ring.

When the plug is in place in the tubular element, this circlip is introduced through the open end of the tubular element and placed in a circular groove provided on the internal face of the tubular element, close to its end. The plug includes at its end directed toward the circlip a circular peripheral recess matched to the form of the circlip in order to be able to receive this when the plug is pushed outwardly by an over-pressure in the container. Thus, when the plug is in abutment against the circlip, it is impossible to remove the circlip, which is then situated in the recess. It will therefore be necessary to wait until the pressure is sufficiently low for it to be possible to push the plug back slightly inwardly in order to be able to then remove the circlip.

Even if this device is generally satisfactory, putting the circlip in position is a relatively difficult operation which takes a certain amount of time and which requires a specialised tool. Moreover, machining of the internal face of the tubular element to prepare the circular groove acting as a housing for the circlip is an operation which increases the manufacturing cost of the unit.

SUMMARY OF THE INVENTION

The aim of the invention is to remedy these disadvantages by proposing a container of the type mentioned provided with outward axial stop means for the plug which are extremely simple both to use and to manufacture, while ensuring operator safety.

The object of the invention is a container under variable pressure connected to a tubular element defining an opening of the container to the outside, the said opening being able to be closed by a plug provided with sealing means and suitable to be introduced by axial sliding into the said tubular element, the said plug being associated with detachable axial stop means capable of cooperating with axial locking means provided in the said tubular element and allowing the said stop means to extend transversally in this in front of the outer end of the said plug to prevent removal of this when there is an over-pressure in the container, characterised by the fact that the said axial locking means of the said stop means include a first slot in the wall of the tubular element and a second slot diametrically opposed to the said first slot, and by the fact that the said stop means are suitable to be introduced transversally into the said tubular element through the said first slot to project outside the said tubular element through the said second slot.

In accordance with other characteristics of the invention:

- the said stop means include an elongate plate, one of the large surfaces of which forms a stop surface for the plug;
- the said plate includes a through central hole and the plug is at its outer end provided with a central rod able to project through the said central hole under the influence of an over-pressure in the container, in order to completely prevent withdrawal of the said stop means;
- the said rod has a cylindrical form and the said central hole in the said plate has a circular form;
- the said rod has the form of a T, and the said central hole in the said plate has an elongate form permitting introduction of the end of the rod through the hole, preventing its inward displacement following a rotation of approximately 90° of the rod;
- the transversal element in the form of a T of the rod includes two parallel lateral flats permitting gripping by a tool to turn the plug;
- the said plate has a front end of smaller width so as to define shoulders on either side of the said plate, the said shoulders being intended to come into abutment against the internal face of the said tubular element on introduction of the plate through the said slots;
- the said plate has a bevelled front end;
- the said plate has a rear end provided with at least one hole permitting gripping by a tool for withdrawal of the plate outside the said tubular element;
- the said plate includes at least at its front end a raised edge forming a transversal locking means when the plug bears against the said stop surface of the said plate;
- the said plate is made of steel.

BRIEF DESCRIPTION OF THE DRAWINGS

The present invention will now be described, by way of example, with reference to the accompanying drawings, in which:

FIG. 1 shows the plug in its position pushed back outwardly against the stop plate by an over-pressure in the chamber;

DESCRIPTION OF THE PREFERRED EMBODIMENT

Figure 1:
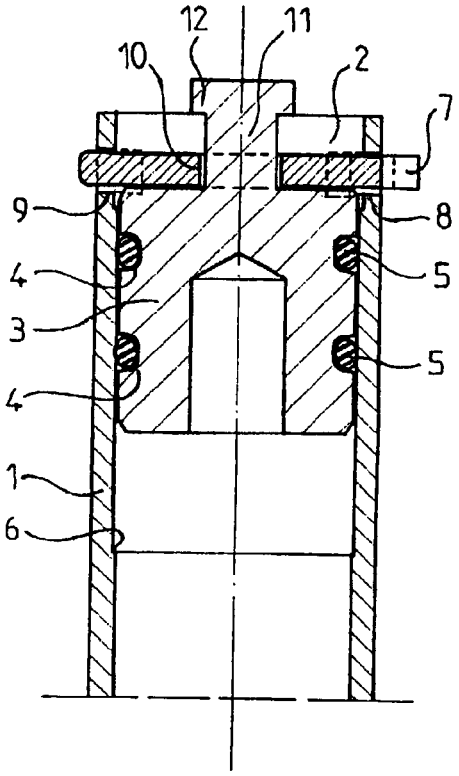
FIG. 1 is a view in partial longitudinal section along the line I—I of FIG. 3 showing a tubular element provided with a plug and with an axial stop plate in accordance with the invention.

In the figures, identical or equivalent elements bear the same reference marks.

The container may be a heat-exchange condenser or any other container under variable pressure. In the case of the condenser, this pressure may drop to atmospheric pressure when the plant of which the condenser forms part is not in operation.

This container, which is itself known, will not be described in detail; it appears in the figures as a tubular element 1 connected to the container and defining an opening 2 of the container to the outside.

The opening 2 is closed by a plug 3 having the overall form of a cylindrical piston which is introduced by axial sliding into the tubular element 1. This plug is preferably made of aluminium and includes seal means including in the example shown two circular grooves 4 acting as housings for two O-rings 5.

The tubular element 1 includes on its internal face a circular shoulder 6 forming a stop organ defining the inward displacement of the plug 3.

Figure 4:
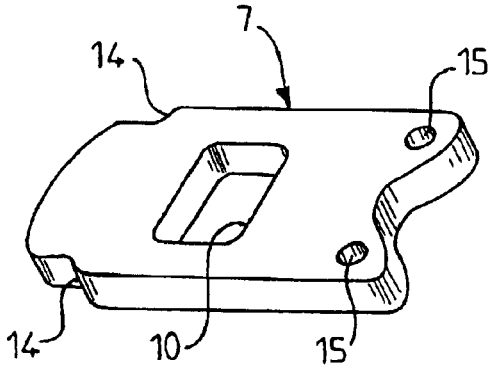
FIG. 4 is a perspective view of a stop plate in accordance with the invention.
Figure 5:
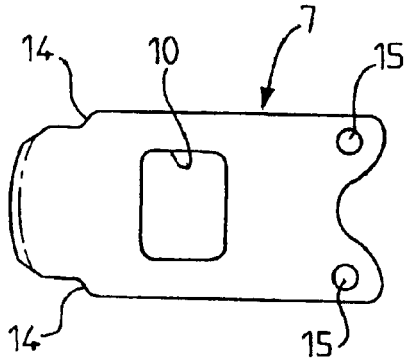
FIG. 5 is a view from above of the stop plate of FIG. 4.
Figure 6:
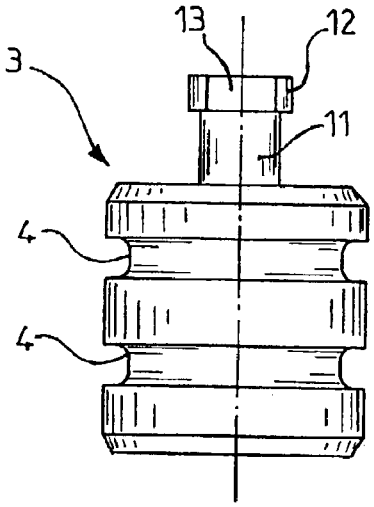
FIG. 6 is a side view of a plug in accordance with the invention.
Figure 7:
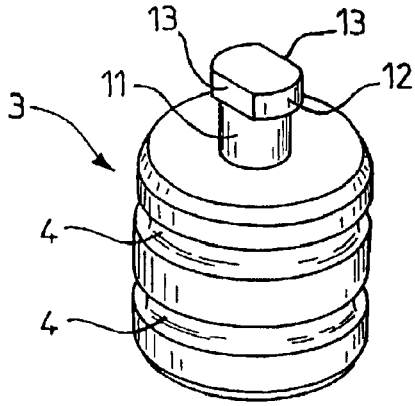
FIG. 7 is a perspective view of the plug of FIG. 6.
Figure 8:
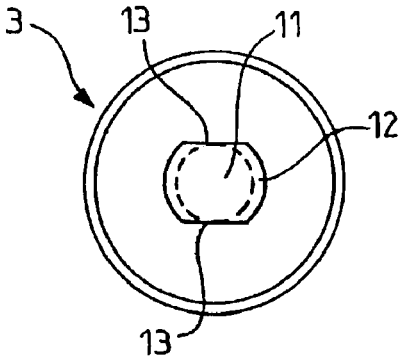
FIG. 8 is a view from above of the plug of FIGS. 6 and 7.

When the plug 3 is in place in the tubular element 1 (see FIG. 2) and it is pushed outwardly by an over-pressure inside the container, its displacement is limited by axial stop means (see FIG. 1). These axial stop means include a plate 7 which is shown in its entirety in FIGS. 4 and 5. In the position of FIG. 1, the lower large surface of the plate forms a stop surface for the plug.

This plate 7, which is preferably made of steel, is introduced transversally into the tubular element 1 through a first slot 8 in its wall to project outside the tubular element through a second slot 9 diametrically opposed to the first slot.

Figure 2:
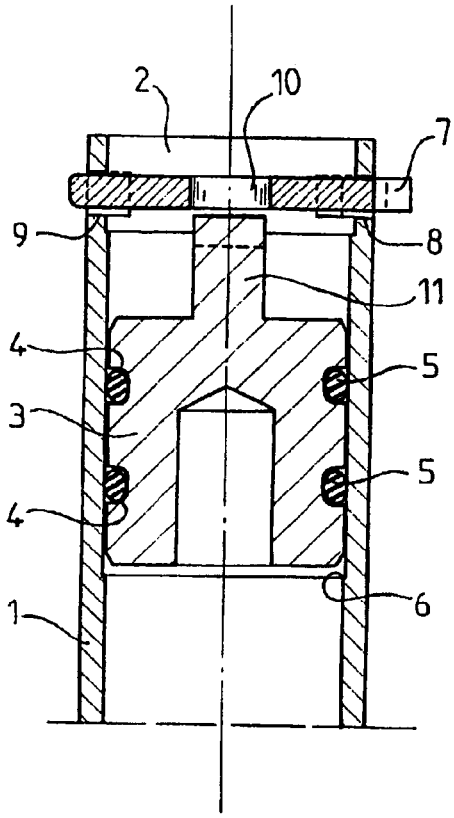
FIG. 2 is a view in partial longitudinal section of a tubular element provided with a plug and an axial stop plate in accordance with the invention; this figure shows the plug in its position pushed back inwardly to place the stop plate in position.
Figure 3:
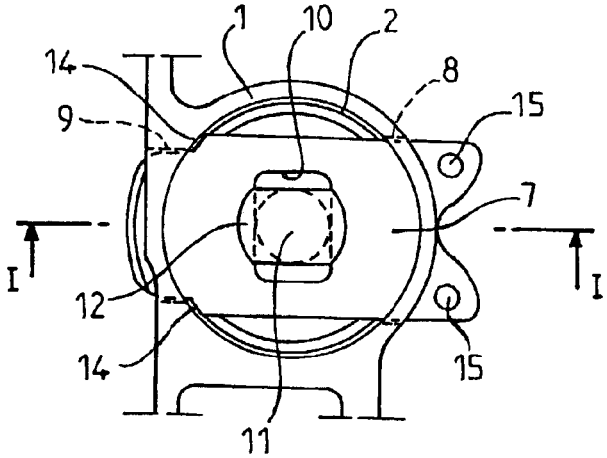
FIG. 3 is a partial view from above of the elements of FIGS. 1 and 2.

The first and second slots 8, 9 form means for axial locking of the plate when this is in the position shown in FIGS. 1 and 2.

When there is an over-pressure in the container and the plug is pressed against the stop surface of the plate, it is already very difficult to withdraw the plate 7 out of the tubular element 1, but to completely prevent its withdrawal, it is provided with a central through hole 10 able to allow passage of a central rod 11 arranged at the outer end of the plug 3. Thus, when the plug is pushed outwardly under the influence of the pressure in the container, the rod projects through this central hole 10 in the plate to lock any movement of withdrawal of the latter.

Safety can be further improved if the rod has a T-shape as shown in the figures. In this case, the central hole 10 in the plate 7 has an elongate form allowing introduction of the end of the rod through this hole when the plug is pushed upwardly by the over-pressure, after which the plug can be turned by approximately 90° to prevent it from descending again when the pressure decreases.

Preferably, the rod includes on the transversal element 12 of its T-shape two parallel lateral flats 13 allowing gripping by a tool to turn the plug 3. In addition, this form of the rod offers an excellent grip for subsequent withdrawal of the plug out of the tubular element 1.

In order to limit the displacement of the plate 7 towards its use position shown in FIGS. 1 and 2, it has in the example shown a front end of reduced width in order to define shoulders 14 on either side of the plate, these shoulders being preferably rounded to match the form of the internal surface of the tubular element 1 against which they will abut on introduction of the plate through the slots 8, 9.

As a modification, the same stop function for the plate when it is placed in position can be obtained by an increased width of the rear part of the plate 7 which then has shoulders coming into abutment against the external surface of the tubular element 1.

To facilitate introduction of the plate 7 through the slots 8, 9 of the tubular element 1, the front end of the plate is preferably bevelled.

Lastly, to facilitate extraction of the plate, this advantageously includes one of more through or blind holes 15 permitting gripping by a suitable tool.

Figure 9:
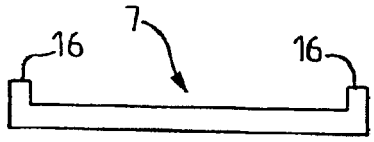
FIG. 9 is a side view of a plate provided with raised edges at its ends.

Finally, FIG. 9 shows a modification of the plate 7 in which the ends of the plate include a raised edge 16 forming a transversal locking means for the plate when the plug 3 bears against the stop surface of the plate. The slots 8, 9 in this case have a greater width than that shown in FIGS. 1 and 2 in order to allow introduction of the plate.

It is, moreover, sufficient to provide such a raised edge at the front end of the plate 7. Of course, in this case the central hole 10 in the plate and the rod 11 of the plug can be quite simply replaced by this raised edge, which simplifies still more the manufacture of the parts. However, all these transversal locking means of the plate can be used in combination with each other.

The plate including an end with a raised edge can easily be manufactured in a stamping and punching press.

In summary, the means in accordance with the invention function in the following manner from a situation in which the plug 3 and the plate 7 are separate from the tubular element 1 of the container.

Firstly, the plug 3 is introduced by axial sliding into the tubular element 1 until it comes into abutment against the circular shoulder 6 on the internal surface of the tubular element. Then, the plate 7 is introduced through the slots 8, 9 in the tubular element until its shoulders 14 come into abutment against the internal surface of the tubular element. When the rod is a circular rod, the device is already in principle ready to function.

However, when the rod 11 of the plug has the form of a T, it is important to take care that it is, on introduction of the plug, oriented as shown in FIG. 2, in order to allow subsequent passage of the rod through the central hole 10 in the plate. Then, an increase in pressure should be caused in the container so that the plug 3 is pushed outwardly, which has the result that it comes into abutment against the plate 7 and that the rod at the same time projects through the central hole in the plate. It is then sufficient to turn the plug through approximately 90° to prevent it from descending again when there is a pressure reduction.

The unit is disassembled in the reverse order. Firstly, the pressure must have been able to fall substantially to be practically equal to atmospheric pressure. To begin with, the plug must be turned through approximately 90° in the case of a T-shaped rod. The plug is then displaced inwardly by pushing on the rod sufficiently for it to be entirely disengaged from the central hole 10 in the plate 7. Then, the plate 7 can be withdrawn from the tubular element in order to allow withdrawal of the plug, which finally gives access to the inside of the tubular element.

A container is thus obtained provided with means for axial stopping of the plug which are particularly simple to employ and manufacture and which in addition give faultless safety for an operator who does not risk freeing the opening 2 while there is an over-pressure in the container.

Of course, the invention is not limited to the examples illustrated and described, but can be applied to any container in which the means described are advantageous.

What is claimed is:

1. A container for enclosing a fluid under variable pressure, comprising a tubular element (1) comprising an outer end defining an opening (2) and axial locking means (8, 9) adjacent the opening; said axial locking means including a first slot (8) in a wall of the tubular element and a second slot (9) diametrically opposed to the said first slot;

a plug (3) closing the opening and introduced by axial sliding into the said tubular element (1), said plug (3) comprising sealing means (5); and detachable axial stop means (7) comprising an elongate plate extending transversally within the tubular element between the outer end and the plug and co-operating said axial locking means to form a stop surface to prevent removal of the plug when there is an over-pressure in the container, said stop means being introduced transversally into said tubular element through said first slot to project outside said tubular element through said second slot, wherein the plate includes a central through hole (10), and wherein the plug includes a central rod (11) projecting through the central hole in response to over-pressure in the container.

2. The container in accordance with claim 1, wherein the rod has a cylindrical form, and the central bole in the plate has a circular form.

3. The container in accordance with claim 1, wherein the rod is T-shaped and includes a transversal element, and the central hole in the plate has an elongate form to permit introduction of the transversal element of the rod through the central hole and preventing its inward displacement following a rotation of the rod of approximately 90°.

4. The container in accordance with claim 3, wherein the transversal element includes two parallel lateral flats (13) permitting gripping by a tool to turn the plug.

5. The container in accordance with claim 1, wherein the said plate has a front end of reduced width so as to define shoulders (14) on either side of the said plate, such that the shoulders abut against the internal surface of the said tubular element.

6. The container in accordance with claim 1, wherein the plate has a beveled front end.

7. The container in accordance with claim 1, wherein the plate further comprises a rear end provided with at least one hole (15) allowing gripping by a tool for withdrawal of the plate out of the tubular element.

8. The container in accordance with claim 1, wherein the plate includes a raised edge at least at its front end for forming a transversal locking means when the plug bears against the stop surface of the plate.

* * * * *